US005972112A

United States Patent [19]

Wood et al.

[11] Patent Number: 5,972,112

[45] Date of Patent: Oct. 26, 1999

[54] DIP TANK WORKPIECE CARRIER WITH ROCKING FRAME

[75] Inventors: Christopher A. Wood, Livonia; Richard G. Hooper, Southfield, both of Mich.

[73] Assignee: Acco Systems, Inc., Warren, Mich.

[21] Appl. No.: 08/943,701

[22] Filed: Oct. 3, 1997

[51] Int. Cl.[6] ..... B05C 3/00

[52] U.S. Cl. ..... 118/423; 118/428; 118/56

[58] Field of Search ..... 118/423, 428, 118/56, 57; 198/378

[56] References Cited

U.S. PATENT DOCUMENTS 4,812,211 3/1989 Sakai ..... 118/425

5,433,783 7/1995 Ichinose et al. ..... 118/423

*Primary Examiner*—Brenda A. Lamb

*Attorney, Agent, or Firm*—Howard & Howard

[57] ABSTRACT

A system for dipping workpieces into a coating tank that includes a conveyor disposed above the tank and a workpiece carrier movable on the conveyor along a path above the tank. The carrier includes a box frame having pivotal corner connections and vertically spaced guide rollers disposed on laterally opposed sides of the frame. Longitudinally spaced cables suspend the carrier frame from winches on the conveyor for selectively raising and lowering the carrier with respect to the conveyor. The winches and cables are also selectively operable for rocking the carrier frame about a horizontal axis lateral to the path of travel along the conveyor. A pair of track rails are disposed in fixed position on laterally opposed sides of the conveyor for engaging the guide rollers on laterally opposed sides of the carrier frame during lowering of the frame into the tank and maintaining horizontal position of the carrier frame during rocking thereof within the tank.

22 Claims, 6 Drawing Sheets

DIP TANK WORKPIECE CARRIER WITH ROCKING FRAME

The present invention is directed to workpiece conveyors, and more particulary to a conveyor system for selectively lowering workpieces on a carrier into a dip tank.

BACKGROUND AND SUMMARY OF THE INVENTION

Electrocoating systems for workpieces such as car bodies conventionally comprise an elongated tank and a system for conveying the workpieces in a continuous motion through the tank. The workpieces are angulated during entry into the tank, which helps expel trapped air. The workpieces are also angulated during exit from the opposing end of the tank, which helps drain solution from the workpieces back into the tank.

Although continuous motion coating systems of the described character are well adapted for large-volume production, the expense associated with systems of this character makes them unsuited for production in lower volumes. Electrocoating of car bodies and other workpieces in such low-volume production is conventionally accomplished by lowering the workpieces in sequence into a vertical dip tank. Although systems of this character are better suited for the economics of low-volume production, there is a problem in that air can become trapped on the undersurfaces of the workpiece, deleteriously affecting the coating process. It is a general object of the present invention to provide a system for dipping workpieces such as car bodies into a tank such as an electrocoating tank in which the workpieces can be rocked or tilted during entry into and exit from the tank and/or while disposed within the tank to help expel air from the undersurfaces of the workpieces, and to help promote circulation of tank liquid around the workpieces. Another and related object of the present invention is to provide a system of the described character in which the workpiece carrier is stabilized during entry into and exit from the tank, and during rocking motion within the tank, so that the carrier and workpiece do not hit the sides or ends of the tank. A further and more specific object of the present invention is to provide a system of the described character that is economical to implement, and that can be readily retrofitted into existing dip tank systems.

A system for dipping workpieces into a tank in accordance with a presently preferred embodiment of the invention comprises a conveyor disposed above the tank and a workpiece carrier movable on the conveyor along a path above the tank. Means on the conveyor selectively lower the carrier from the conveyor path into the tank, and provide for rocking the carrier within the tank. A track engages the carrier during lowering into the tank and stabilizes position of the carrier during rocking within the tank, and during entry into and exit from the tank, so that the carrier and workpieces carried thereby do not hit the sidewalls of the tank.

The carrier in the preferred embodiment of the invention takes the form of a box frame having pivotal connections at each corner for accommodating rocking of the frame while horizontal position of the frame is maintained by the track. Spaced guide rollers on the frame engage rails of the track as the frame is lowered into the tank. In order to accommodate motion of the carrier along the conveyor into alignment with the track, the track rails define a slot for passage of the guide rollers therethrough, and a pair of trap blocks for selectively closing the slot and capturing the guide rollers between the track rails. The trap blocks include longitudinally extending and vertically angulated cam fingers for camming the guide rollers into position between the track rails, and thereby accommodating slight longitudinal misalignment of the rollers with respect to the track rails. The track also includes a camming surface oriented at an angle to the longitudinal direction of motion for camming the rollers into the track slot, and thereby accommodating slight lateral misalignment of the carrier guide rollers with respect to the track slot.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF THE PREFERRED EMBODIMENTS

Figure 1:
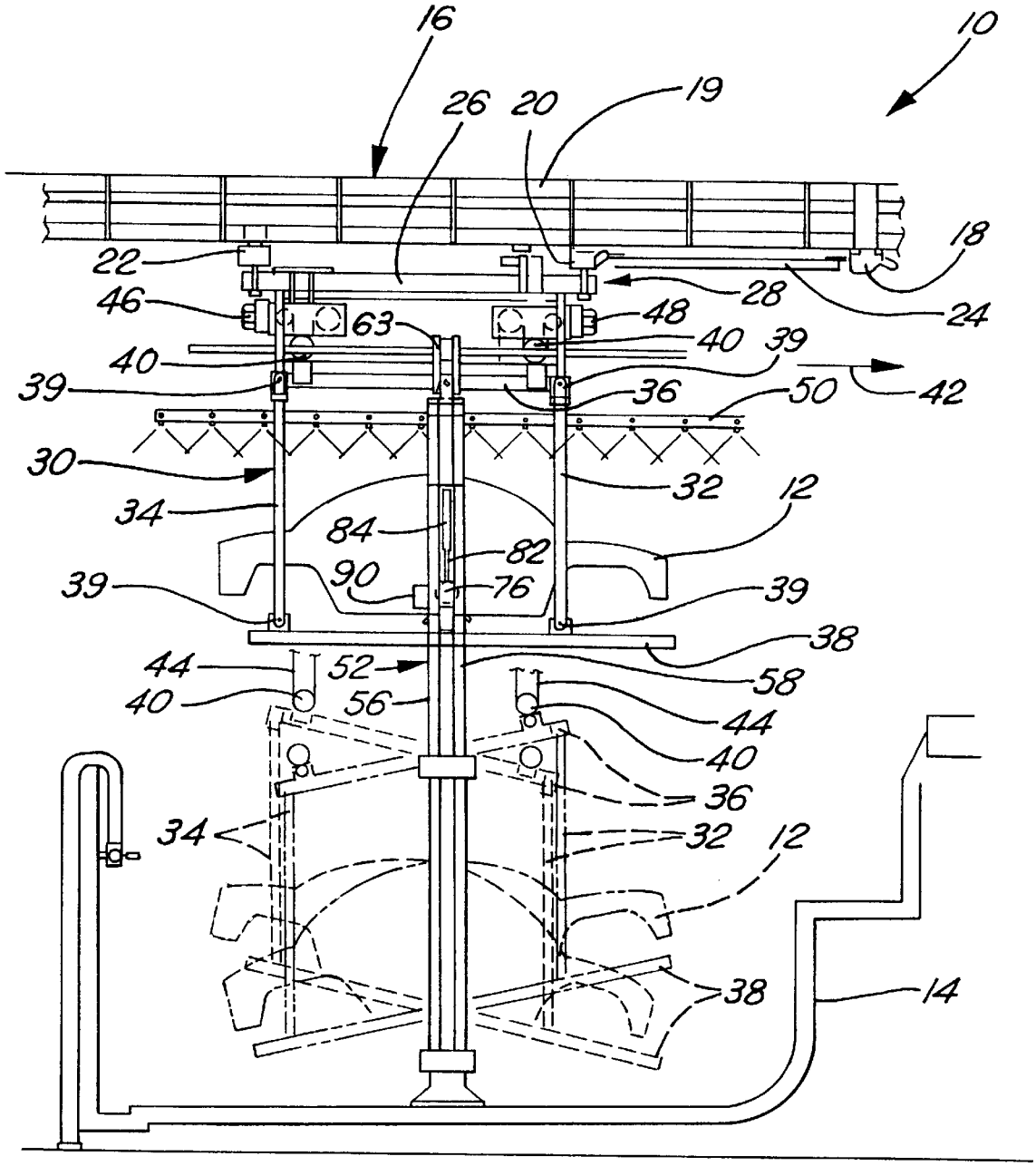
FIG. 1 is schematic fragmentary elevational view of a system for dipping workpieces into a tank in accordance with a presently preferred embodiment of the invention.
Figure 2:
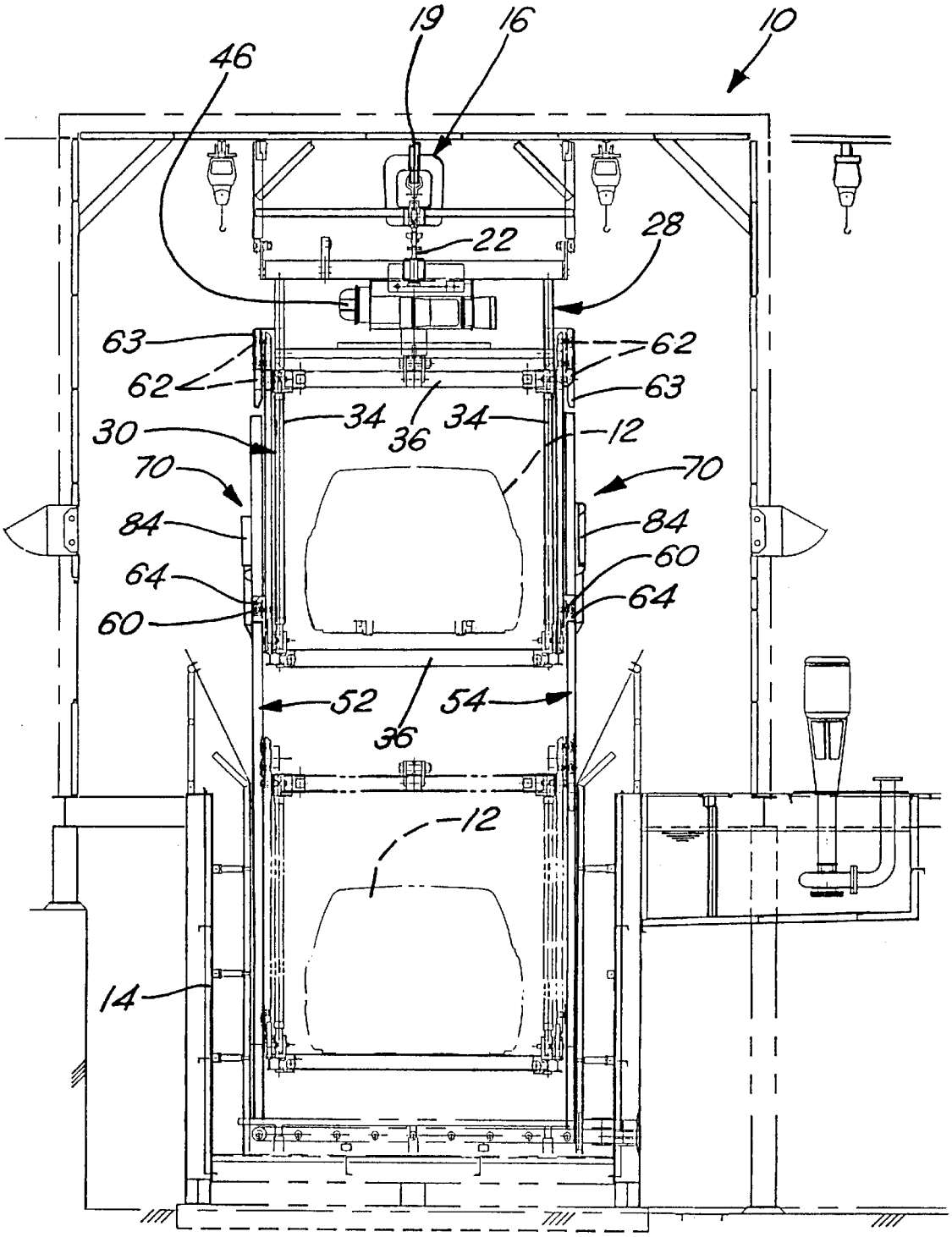
FIG. 2 is a schematic fragmentary end elevational view of the system illustrated in FIG. 1.
Figure 3:
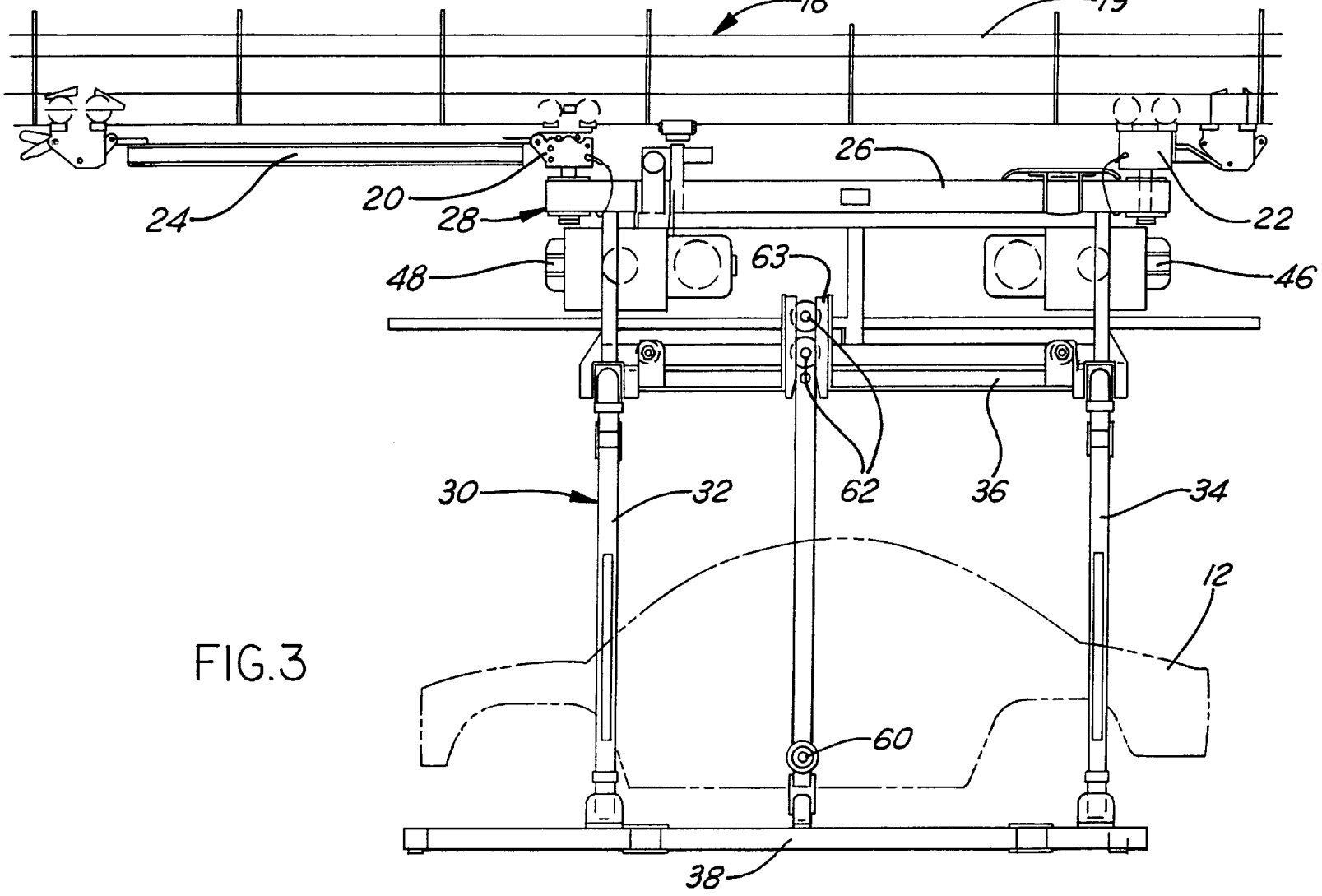
FIG. 3 is a fragmentary elevational view on an enlarged scale of the conveyor and carrier frame illustrated in FIG. 1.
Figure 4:
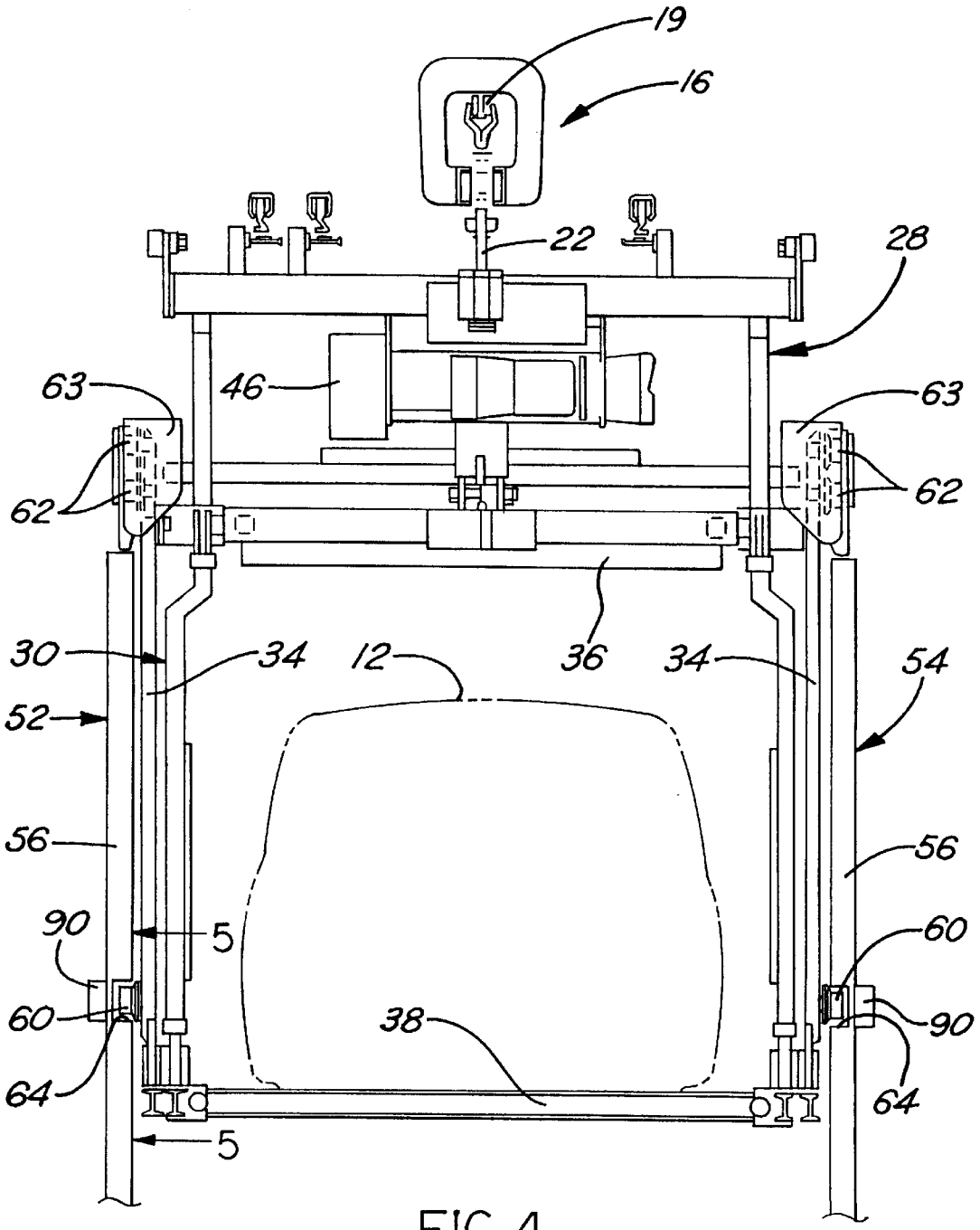
FIG. 4 is a fragmentary end elevational view on an enlarged scale of the conveyor and carrier frame as illustrated in FIG. 2.

FIGS. 1 and 2 illustrate a system 10 for dipping workpieces 12 into a dip tank 14 in accordance with a presently preferred embodiment of the invention. A conveyor 16 is disposed above tank 14 for conveying workpieces 12 along a path of travel above the tank. Although conveyor 16 could be of any conventional type, it is presently preferred that conveyor 16 comprise a power-and-free conveyor having a lead trolley 18 and a pair of spaced trailing trolleys 20, 22 movable along a track 19 and interconnected by carrier load bars 24, 26 to form an upper conveyor carrier 28. A lower carrier 30 comprises a box frame having vertical link arms 32, 34 interconnected by horizontal cross members 36, 38. Arms 32, 34 and cross members 36, 38 are pivotally interconnected at joints 39 so as to permit distortion of the box frame about a lateral axis while maintaining parallel geometry between the opposing arms and members. (It will be appreciated that directional adjective's such as "longitudinal" and "lateral" are taken with respect to be the direction 42 of longitudinal motions of workpieces.)

Carrier frame 30 has a pair of upper pulleys 40 on upper cross member 36, with the pulleys being spaced from each other longitudinally in the direction 42 of travel of conveyor 16. A cable 44 is trained around each pulley 40 from and to an associated winch 46, 48 on upper carrier 28. Winches 46, 48 are selectively operable together for raising and lowering lower carrier 30 with respect to conveyor 16 and tank 14, and separately for rocking lower frame 30 as shown in phantom in FIG. 1. Thus, conveyor 16 is operated to convey workpieces 12 in direction 42. When conveyor carriers 28, 30 reach a position above tank 14, indicated by suitable limit switches on the conveyor, the conveyor motion is arrested, and lower carrier 30 and workpiece 12 may be selectively lowered into tank 14. After a suitable period of time, lower carrier 30 and workpiece 12 may be raised from the dip tank, and then conveyed in direction 42 to a subsequent processing stage. A spray bar 50 is positioned above tank 14 for selectively spraying cleansing or coating solution onto the workpiece at it is raised from the tank. Conveyor trolleys 20, 22 also include suitable means for engaging buses on conveyor track 19 for applying electrical energy workpieces 12 while suspended within tank 14.

A pair of guide tracks 52, 54 are disposed on the laterally opposed sides of conveyor 16 for guiding vertical motion of carrier 30 during raising and lowering with respect to dip tank 14, and for maintaining horizontal position of carrier 30 and workpieces 12 during rocking of the carrier and workpieces above or within the dip tank. Guide tracks 52, 54 are mirror images of each other. Each guide track 52, 54 includes a pair of vertically extending horizontally longitudinally spaced rails 56, 58, preferably in the form of hollow tube stock. Rails 56, 58 extend from an upper position adjacent to the path of travel of upper carrier 28 to a lower position within tank 14. Rails 56, 58 are spaced from each other by a distance sufficient to accommodate passage of vertically spaced flange rollers 60, 62 carried by carrier 30. During motion of the carrier along conveyor 16, upper guide rollers 62 are captured within a keeper 63 carried by upper carrier 28 to stabilize lower carrier 30. Upper guide rollers 62 travel in a path disposed above the upper ends of guide rails 56, 58, while lower guide rollers 60 travel in a path that intersects the guide rails. In order to accommodate passage of lower flange rollers 60, there is provided a slot 64 through each track 52, 54. Thus, as the upper and lower carriers are conveyed by conveyor 16 in direction 42, the lower carrier is brought into a position in which the upper rollers 62 on each side of carrier 30 are brought into alignment with the upper end of respective tracks 52, 54 and the lower rollers 60 on each side of carrier 30 are brought through slots 64 into alignment between guide track rails 56, 58.

Figure 5:
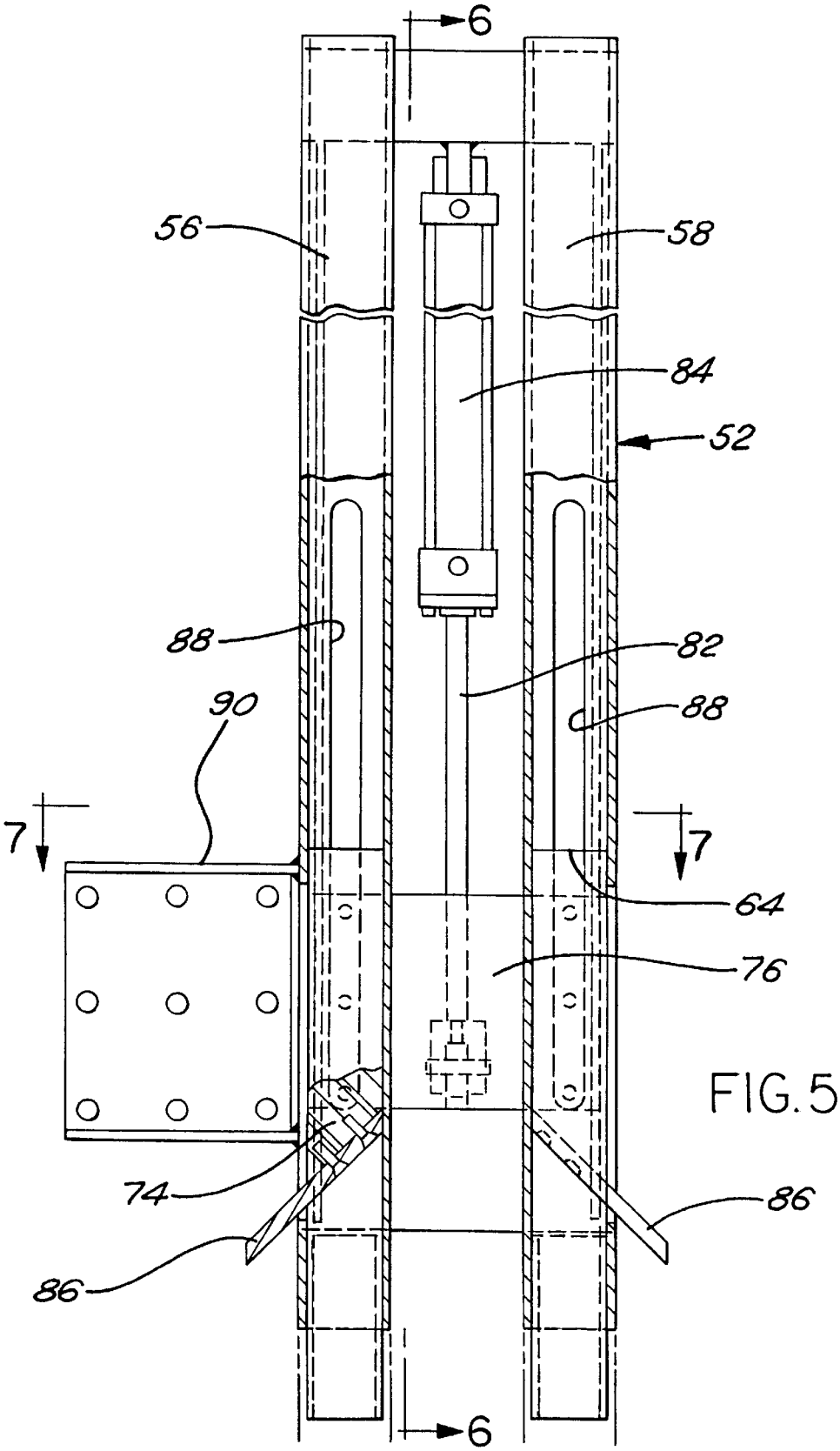
FIG. 5 is a fragmentary elevational view taken substantially along the 5—5 in FIG. 4.
Figure 6:
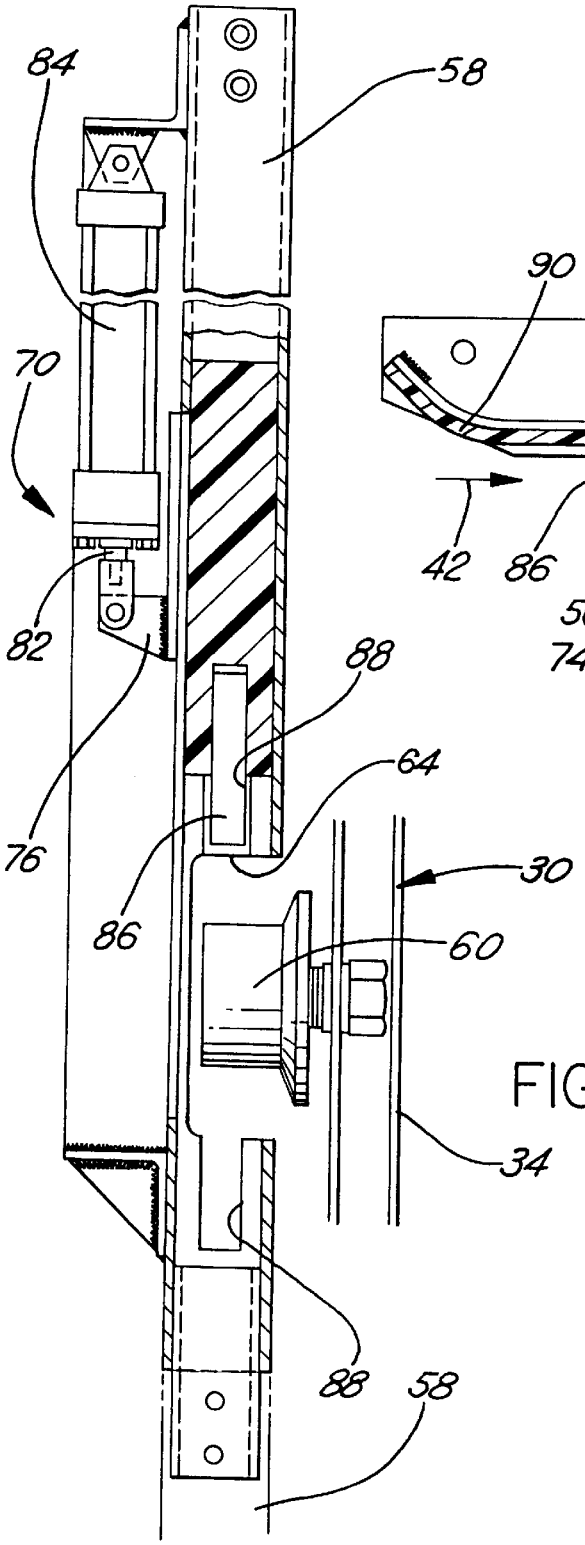
FIGS. 6 and 7 are fragmentary sectional views taken substantially along the lines 6—6 and 7—7 in FIG. 5.
Figure 7:
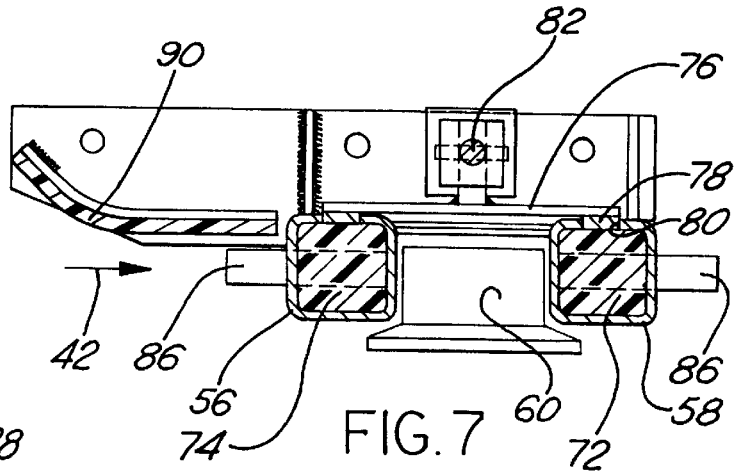

A trap assembly 70 is disposed on each track 52, 54 for closing the respective slots 64 and thereby trapping rollers 60 between the track rails 56, 58. Each trap assembly 70 comprises a pair of trap blocks 72, 74 of plastic or other suitable construction slidably disposed within the associated tubular rail 56, 58. Each block 72, 74 is coupled to a cross brace 76 by a pin 78 that extends through a slot 80 in the associated rail 56, 58. Cross brace 76 is coupled to the rod 82 of a linear actuator 84, which may be hydraulically, pneumatically or electrically operated. Thus, upon operation of actuator 84, trap blocks 72, 74 are moved simultaneously longitudinally within the associated rails 56, 58 either downwardly in FIGS. 5 and 6 so as to close slot 64 and trap roller 60 therebetween, or upwardly to open slot 64 so as to permit passage of roller 60 into or out of the guide track. A cam finger 86 extends longitudinally and at a vertical angle from each trap block 72, 74. Fingers 86 are preferably of wear-resistant metallic composition. Fingers 86 cooperate with slots 88 in rails 58, 56 for engaging and camming roller 60 into position between trap blocks 72, 74, and thereby accommodating slight longitudinal misalignment of rollers 60 with respect to tracks 52, 54 when conveyor motion is arrested and trap blocks 72, 74 are lowered. A cam plate 90 extends longitudinally from each track rail 56 in a direction opposed to the direction 42 of conveyor motion. Cam plates 90 on both sides of the conveyor cooperate with guide rollers 60 on both sides of the carrier to cam the rollers into slots 64 on both sides of the conveyor, and thereby accommodate slight lateral misalignment between carrier 30 and guide racks 52, 54.

When conveyor 16 brings upper and lower carriers 28, 30 into position above tank 14 in alignment with lateral guide tracks 52, 54, traps 70 are activated on both sides of the conveyor for closing the respective slots 64 and thereby capturing rollers 60 within the respective tracks. Winches 46,48 are then energized simultaneously to lower carrier 30 and workpiece 12 into dip tank 14. One winch 46, 48 may be advanced with respect to the other so that carrier 30 and workpiece 12 are slightly tilted during entry into tank 14, which helps expel air from the undersurfaces of workpiece 12. Within tank 14, carrier 30 and workpiece 12 may be rocked by selective alternate operation of winches 46, 48 as shown in phantom in FIG. 1. This rocking or jostling of workpiece 12 helps obtain uniform coating over the entire surface of the workpiece. Capture of rollers 60, 62 within the laterally opposed tracks 52, 54 maintains a fixed horizontal position of the lower carrier and workpiece during such rocking action, preventing the lower carrier and workpiece from hitting the sides of tank 14. After a suitable time interval, lower carrier 30 and workpiece 12 are raised from the tank 14 by operation of winches 46, 48. Once again, operation of the winches may be staggered so that the workpiece is angulated when raised from the tank, which helps drain coating fluid from the workpiece. Spray bar 50 may be operated at this time to rinse coating solution from the workpiece and/or spray a suitable solution on the exterior surface of the workpiece. When lower conveyor 30 and workpiece 12 are in the fully raised position illustrated in FIGS. 1 and 2 with rollers 62 nested within keepers 63, conveyor 16 may again be operated so as to move the workpiece to a subsequent processing station and bring a subsequent workpiece into position for lowering into tank 12. Rollers 62 are provided in adjacent pairs for added stability within keepers 63.

We claim:

1. A conveyor system for dipping workpieces in a dip tank comprising:

a horizontal conveyor disposed above said dip tank;

a workpiece carrier having forward and rearward ends moveable on said horizontal conveyor along a path above said dip tank including a roller adjacent a mid-portion of said carrier having an axis generally perpendicular to the longitudinal axis of said carrier; and a vertical lift assembly lowering said carrier into said dip tank, rocking said carrier about said axis of said roller thereby raising and lowering said forward and rearward ends of said carrier, and raising said carrier out of said dip tank.

2. The conveyor system for dipping workpieces in a dip tank as defined in claim 1, wherein said vertical lift assembly includes spaced vertical rails each having a clamp which selectively receives and captures said roller.

3. The conveyor system for dipping workpieces in a dip tank as defined in claim 2, wherein said clamps each include a horizontal slot receiving said roller.

4. The conveyor system for dipping workpieces in a dip tank as defined in claim 3, wherein the opening to said slots include wedge-shaped surfaces which receive and guide said roller into said slots.

5. The conveyor system for dipping workpieces in a dip tank as defined in claim 2, wherein said clamps each include opposed relatively moveable blocks which receive said roller therebetween, at least one of said blocks moveable toward the opposed block to capture said roller.

6. The conveyor system for dipping workpieces in a dip tank as defined in claim 2, wherein said clamps each include a horizontal slot receiving said roller.

7. The conveyor system for dipping workpieces in a dip tank as defined in claim 6, wherein said roller comprises flange rollers on opposed sides of said conveyor.

8. The conveyor system for dipping workpieces in a dip tank as defined in claim 1, wherein said roller comprises rollers on opposed sides of said carrier and said vertical lift assembly includes spaced vertical rails each having a clamp which selectively receives and captures one of said rollers.

9. The conveyor system for dipping workpieces in a dip tank as defined in claim 1, wherein said carrier includes a parallelogram carrier assembly including spaced pivotably connected generally vertical horizontal and horizontal members supporting said workpiece as said workpiece is rocked about said axis of said roller preventing longitudinal or horizontal movement of said workpiece in said dip tank.

10. The conveyor system for dipping workpieces in a dip tank as defined in claim 9, wherein said vertical lift assembly includes vertical support members pivotably connected to the upper horizontal member of said parallelogram carrier assembly, said vertical support members alternatively moving upwardly and downwardly to rock said workpiece carrier about said axis of said roller.

11. A carrier system for dipping a vehicle body in an electrocoating dip tank, comprising:

a horizontal conveyor disposed above said electrocoating dip tank;

a carrier supporting a vehicle body having forward and rearward ends adjacent the forward and rearward ends of said vehicle body moveable on said horizontal conveyor along a path above said electrostatic dip tank including rollers adjacent a midportion of said carrier on opposed sides of said carrier having a generally horizontal axis perpendicular to the longitudinal axis of said vehicle body; and a vertical lift assembly having clamps which selectively receive said rollers, said vertical lift assembly lowering said conveyor into said electrostatic dip tank, rocking said carrier about said horizontal axis of said rollers thereby raising and lower said forward and rearward ends of said vehicle body, and then raising said carrier out of said electrostatic dip tank.

12. The conveyor system for dipping a vehicle body in an electrostatic dip tank as defined in claim 11, wherein said vertical lift assembly includes spaced vertical rails, each vertical rails having one of said clamps which selectively receives and captures one of said rollers.

13. The conveyor system for dipping a vehicle body in an electrostatic dip tank as defined in claim 12, wherein said clamps each include a horizontal slot receiving one of said rollers.

14. The conveyor system for dipping a vehicle body in an electrostatic dip tank as defined in claim 11, wherein said clamps each include opposed relatively moveable blocks which receive one of said rollers therebetween, at least one of said blocks moveable toward the opposed block to capture said roller.

15. The conveyor system for dipping a vehicle body in an electrostatic dip tank as defined in claim 14, wherein said rollers comprise flange rollers.

16. The conveyer system for dipping a vehicle body in an electrostatic dip tank as defined in claim 1, wherein said conveyor includes a parallelogram carrier assembly supporting said vehicle body including spaced pivotably connected generally vertical and horizontal members supporting said vehicle body as said vehicle body is rocked about said axis of said rollers and preventing longitudinal or horizontal movement of said vehicle body in said electrostatic dip tank.

17. The conveyor system for dipping a vehicle body in an electrostatic dip tank as defined in claim 16, wherein said vertical lift assembly includes vertical support members pivotably attached to the upper horizontal member of said parallelogram carrier assembly supporting said vehicle body, said vertical support members alternatively moving upwardly and downwardly to rock said carrier about said axis of said rollers.

18. A conveyor system for dipping workpieces in a dip tank, comprising:

a horizontal conveyor above said dip tank;

a workpiece carrier having forward and rearward ends moveable on said horizontal conveyor along a path above said dip tank including rollers on opposed sides of said carrier adjacent a mid portion of said carrier having an axis generally perpendicular to said carrier; and a vertical lift assembly including spaced vertical rails on opposed sides of said carrier each having a clamp which selectively receives and captures one of said rollers, said vertical lift assembly lowering said carrier into said dip tank, rocking said carrier about said axis of said rollers thereby raising and lowering said forward and rearward ends of said carrier, and raising said carrier out of said dip tank.

19. The conveyor system for dipping workpieces in a dip tank as defined in claim 18, wherein said clamps each include a horizontal slot in said vertical rails which receives one of said rollers.

20. The conveyor system for dipping workpieces in a dip tank as defined in claim 19, wherein said rails are tubular and each of said clamps includes opposed relatively moveable blocks located within said tubular rails on opposed sides of said slots which receive one of said rollers therebetween, at least one of said blocks moveable toward the opposed block to capture one of said rollers.

21. The conveyor system for dipping workpieces in a dip tank as defined in claim 19, wherein said rollers are flange rollers.

22. The conveyor system for dipping workpieces in a dip tank as defined in claim 19, wherein the opening to each of said slots include opposed wedge-shaped surfaces which receives and guides said rollers into slots.

* * * * *